US006837830B2

(12) United States Patent
Eldridge

(10) Patent No.: US 6,837,830 B2
(45) Date of Patent: Jan. 4, 2005

(54) APPARATUS USING MULTI-DIRECTIONAL RESISTANCE IN EXERCISE EQUIPMENT

(76) Inventor: Mark W. Eldridge, P.O. Box 70, 816 Hwy. 11 C, Brasher Falls, NY (US) 13613

( * ) Notice: Subject to any disclaimer, the term of this patent is extended or adjusted under 35 U.S.C. 154(b) by 236 days.

(21) Appl. No.: 10/286,279

(22) Filed: Nov. 1, 2002

(65) Prior Publication Data

US 2004/0087418 A1 May 6, 2004

(51) Int. Cl.[7] ..... A63B 22/00
(52) U.S. Cl. ..... 482/54
(58) Field of Search ..... 482/51, 54, 14, 482/39, 66, 121–124, 145, 111, 112

(56) References Cited

U.S. PATENT DOCUMENTS 1,364,699 A * 1/1921 Brown ..... 482/54
2,017,128 A * 10/1935 O'Neill, Jr. ..... 482/54
4,256,302 A 3/1981 Keiser et al.
4,354,676 A 10/1982 Ariel
4,544,154 A 10/1985 Ariel
4,625,962 A * 12/1986 Street ..... 482/116
4,645,201 A 2/1987 Evans
4,915,373 A 4/1990 Walker
5,145,481 A 9/1992 Friedebach
5,167,601 A 12/1992 Frappier
5,328,422 A * 7/1994 Nichols ..... 482/52
5,385,519 A 1/1995 Hsu et al.
5,385,520 A 1/1995 Lepine et al.
5,444,812 A * 8/1995 Thibodeau ..... 388/840
5,518,480 A 5/1996 Frappier
5,876,308 A 3/1999 Jarvie
5,941,804 A 8/1999 Johnston et al.
6,120,416 A 9/2000 Walker
6,123,649 A * 9/2000 Lee et al. ..... 482/54
6,126,575 A * 10/2000 Wang ..... 482/54
6,146,315 A * 11/2000 Schonenberger ..... 482/69
6,186,290 B1 2/2001 Carlson
6,231,484 B1 5/2001 Gordon
6,234,935 B1 5/2001 Chu
6,413,195 B1 7/2002 Barzelay

* cited by examiner

*Primary Examiner*—Stephen R. Crow
(74) *Attorney, Agent, or Firm*—Michael P. Williams; Bond, Schoeneck & King, PLLC

(57) ABSTRACT

An exercise apparatus includes a frame for supporting all the components of the apparatus and a multi-directional resistance means for providing a user of the apparatus the ability to duplicate actual athletic procedures. The apparatus includes a treadmill for the user to operate with the multi-directional resistance means and at least two connection means between the user legs the multi-directional resistance means. A front bar is mounted on the frame for the user to hold onto while duplicating an athletic procedure. Finally, there is a controlling means to adjust the multi-directional resistance means for changing the effect of the users' workout.

29 Claims, 6 Drawing Sheets

APPARATUS USING MULTI-DIRECTIONAL RESISTANCE IN EXERCISE EQUIPMENT

FIELD OF THE INVENTION

This invention relates to exercise equipment and a method of operating the same, and more particularly to the use of multi-directional resistance in an exercise machine that allows the user to duplicate actual athletic procedures.

BACKGROUND OF THE INVENTION

Maintaining proper fitness is a growing concern for many Americans. The medical community has become increasingly aware in the value of exercise to the overall health of an individual. Furthermore, athletes need regular and stringent workouts to maintain their abilities. As a result, more and more individuals are committed to a routine of regular exercise. However, it is difficult for many to devote a great amount of time in their regular exercise routine. Also, many prefer to workout in the home instead of a gymnasium because this provides the flexibility of working out when a schedule allows the time. Simultaneously, there is a demand for exercise equipment that is capable of providing an effective stringent workout with the ability to duplicate athletic routines.

As is known by the practitioner in the art, a conventional running exercise machine uses rotary potentiometers installed on the consoles in front of the machines. These potentiometers will vary the speed of the machine allowing the user to run faster or slower. However, the only resistance provided by this kind of running machine is through the tilt of the running machine platform. If the user wants a harder workout then the user will raise the incline of the platform simulating the resistance of the incline of a hill. Also, if the user desires an easier workout they will lower the incline of the platform. The problem with this type of resistance in the running machine is that there is a limited range and direction of resistance for increasing the strength of a users' lower extremities or duplicating athletic procedures.

The running machine described in U.S. Pat. No. 5,444,812, entitled "Automatic Speed Servo-Control Apparatus For Electrically Powered Walking-Running Exercise Machine," to Thibodeau, is confined to a speed servo-control for a user to walk/run on a moving belt with a direct current drive input that controls the speed of the moving belt. A cord assembly includes a belt that is tied around the users' waist and connected to a control unit that allows the user to increase or decrease the speed of the moving belt. The apparatus does not provide the user with multi-directional resistance and control to their legs providing for appropriate proprioceptive neuromuscular facilitation within the specific musculature. The user is limited in their ability to strengthen their legs and stride and cannot duplicate athletic procedures.

In another exercise machine as described in U.S. Pat. No. 5,385,520, entitled "Ice Skating Treadmill," to Lepine et al., some of the protocols for the biomechanics of ice skating are duplicated in an ice skating treadmill. The ice skating treadmill relies on a lubricated rotatable surface providing a coefficient of friction close to that of natural ice. The ice skating treadmill allows natural ice skating behavior in a fixed position. However, this ice skating treadmill does not provide the capability to provide multi-directional resistance on the lower extremities in a correct biomechanical position. It does not provide for appropriate proprioceptive neuromuscular facilitation within the specific musculature duplicating athletic procedures. The user is limited in their ability to strengthen their legs and stride.

What is needed is an exercise machine that will incorporate a multi-directional resistance means providing different levels of strengthening to the users' lower extremities and duplicating actual athletic procedures.

SUMMARY OF THE INVENTION

It is an aspect of this invention to provide a running machine with a multi-directional resistance directed at the user, which allows a directed strengthening of the users' lower extremities by duplicating actual athletic procedures.

It is another aspect of this invention to provide an ice skating machine with a multi-directional resistance directed at the user, which allows a directed strengthening of the users' lower extremities by duplicating actual athletic procedures.

To accomplish these and other aspects of this invention an exercise apparatus includes a frame for supporting all the components of the apparatus and a multi-directional resistance means for providing a user of the apparatus the ability to duplicate actual athletic procedures. The apparatus includes a treadmill for the user to operate with the multi-directional resistance means and at least two connection means between the users' legs and the multi-directional resistance means. A front bar is mounted on the frame for the user to hold onto while duplicating an athletic procedure. Finally, there is a controlling means to adjust the multi-directional resistance means for changing the effect of the users' workout.

DETAILED DESCRIPTION OF THE INVENTION

While the present invention is described below with reference to a running and skating machine, a practitioner in the art will recognize the principles of the present invention are applicable elsewhere.

Figure 1:
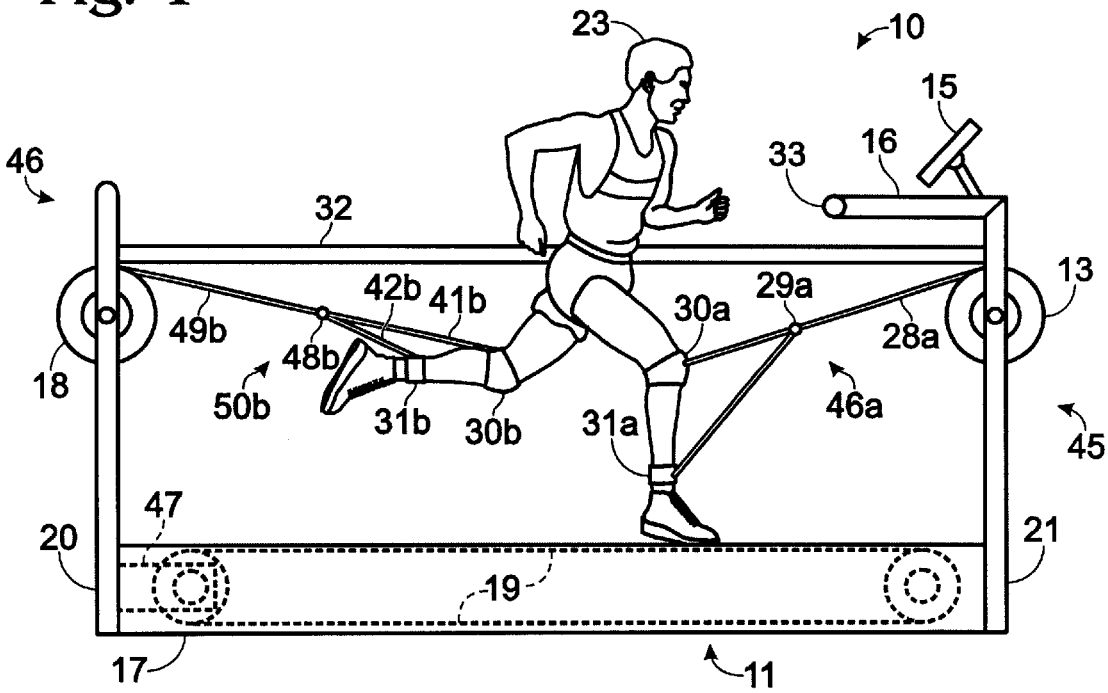
FIG. 1 shows a side view of the exercise apparatus using four flywheels as the resistance means in the preferred embodiment of the invention.
Figure 7A:
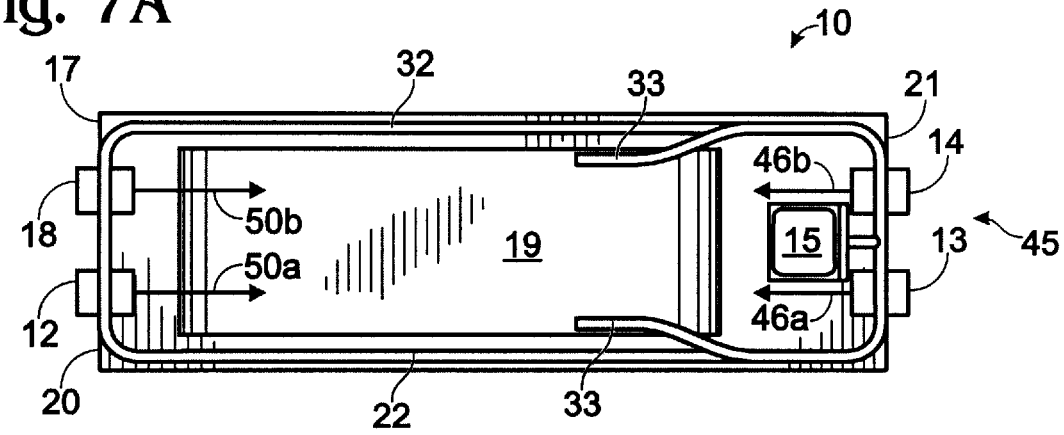
FIG. 7A illustrates the top view of the four flywheel application in the preferred embodiment of the invention.

FIG. 1 shows an exercise treadmill apparatus 10 in the preferred embodiment of the invention. A frame 11 supports all the components of the apparatus 10. This includes the treadmill platform 17, an endless belt 19, a multi-directional resistance means 45, a controlling means 15, a front bar 33, a left side bar 32 and a right side bar 22 (FIG. 7A). The front bar 33, similar in design to a bicycle handle bar, is for user 23 to hold onto while strengthening their stride and lower extremity muscles. A left sidebar 22 and a right sidebar 32 gives the user 23 the ability to do crossover strides and to duplicate actual athletic procedures when using the multi-directional resistance means 45.

The user 23 may operate the endless belt 19 in conjunction with the multi-directional resistance means 45 or may prefer not to operate the endless belt 19 when using the multidirectional resistance means 45. The multi-directional resistance means 45 provides the user 23 with the ability to strengthen their leg stride and mussels and duplicate actual athletic procedures. Furthermore, the multi-directional resistance means 45 provides either an isotonic or isokinetic resistance that is directly proportional to the intensity of effort applied by the user 23. The multi-directional resistance means 45 in apparatus 10 includes four flywheels each containing a magnetic brake, recoil and a one-way clutch. Alternately, the flywheels are substitutable with four hydraulic mechanisms each containing a recoil and a one-way clutch.

Figure 3:
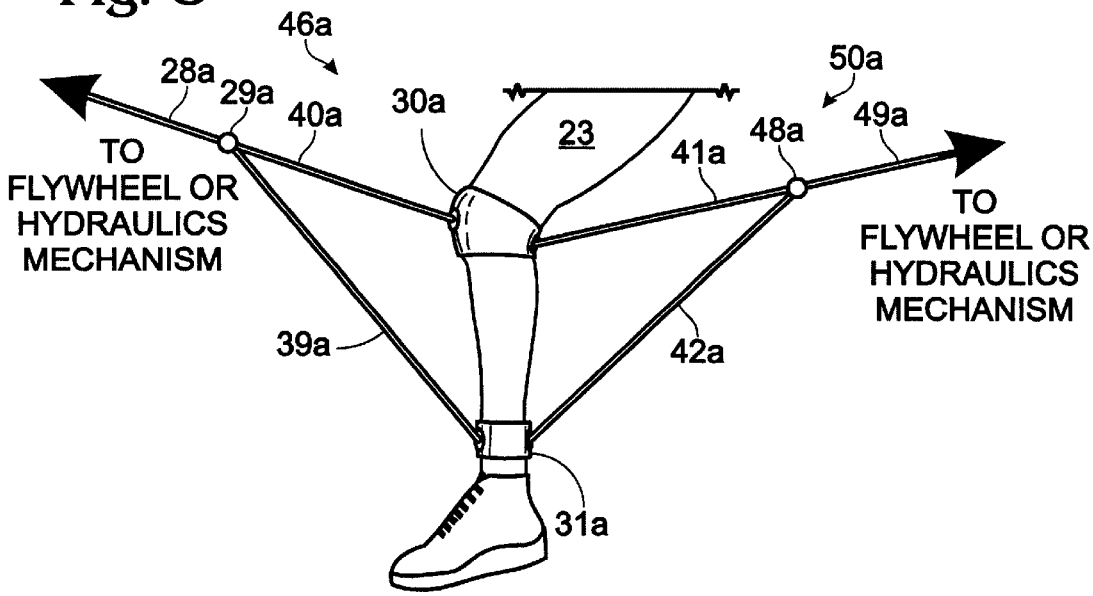
FIG. 3 shows a detailed view of the right knee and leg strap used in the preferred embodiment of the invention.
Figure 4:
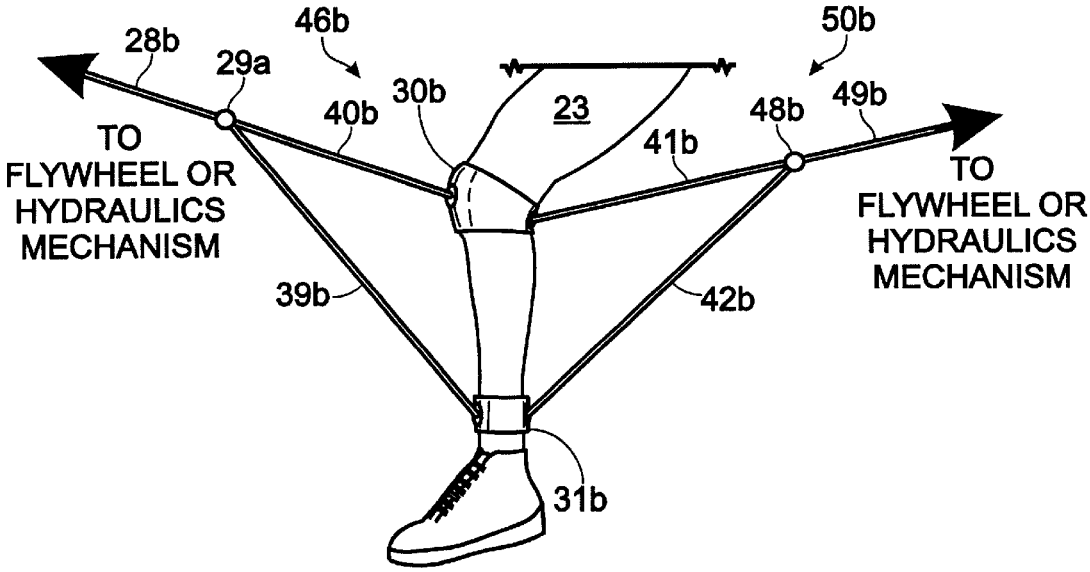
FIG. 4 shows a detailed view of the left knee and leg strap that is used in the preferred embodiment of the invention.

There are four connection means between the two legs of user 23 and the multi-directional resistance means 45. For example, the front right leg connection means 46*a* includes a right knee strap 30*a*, a right leg strap 31*a*, a first element 28*a* and a first rotatable structure 29*a*. Furthermore, the rear left leg connection means 50*b* includes a knee strap 30*b*, a leg strap 31*b*, a left leg second rotatable structure 48*b*, a left leg third segment 41*b*, a left leg fourth segment 42*b* and a left leg second element 49*b*. There also exists a rear right leg connection means 50*a* (FIG. 3) and a front left leg connection means 46*b* (FIG. 4).

A controlling means 15 provides the user 23 with the ability to independently control the force and direction of resistance from the multi-directional resistance means 45 and further independently control the speed and tilt of the treadmill 19. The controlling means 15 provides the user 23 with the ability to regulate the intensity of their workout, switch between isotonic and isokinetic resistance (constant force or maximum speed) and assist in the duplication of athletic procedures. The controlling means 15 panel is positioned on mounting structure 16.

The endless belt 19 is adaptable to a variety of applications including, but not limited to, a running treadmill and an ice skating treadmill. If apparatus 10 is a running treadmill, the endless 19 users a rubberized endless belt slightly less than the width of the treadmill platform 17, wherein the platform is about 2 to 3 feet in width. The rubberized polyester belt will contain parallel ridges, from side-to-side of the belt, all the way around the endless belt 19. The ridges will provide to the user 23 a non-slip surface so that they may safely exercise using apparatus 10. The belt tension on the endless belt 19 is adjustable on the treadmill platform 17 to provide a properly fitted belt to the treadmill. The endless belt 19 contains a motor/drive arrangement 47 mounted inside the treadmill platform 17. The motor drive arrangement is a typical arrangement as known by the practitioner in the art. However, the treadmill motor/drive 47 will provide an endless belt 19 speed from about zero to 28 mph. Alternately, the endless belt 19 further consists of the proper mechanical connections with the motor 47 to allow the endless belt 19 to be freewheeling, that is, the endless belt will move independent of the motor 47. Furthermore, a servo-motor adjusts the elevation of the endless belt 19 as is typically used in the art. The user 23 regulates the speed and elevation of the endless belt 19 from the panel of the controlling means 15. The adjustment of the endless belt 19 is accomplished by use of a potentiometer as is typical in the art. However, the endless belt 19 speed is also controllable by the use of a variable speed DC motor and hardware in other applications. This includes an AC to DC inverter so that the treadmill is conveniently plugged into any home 110 VAC outlet.

Figure 8:
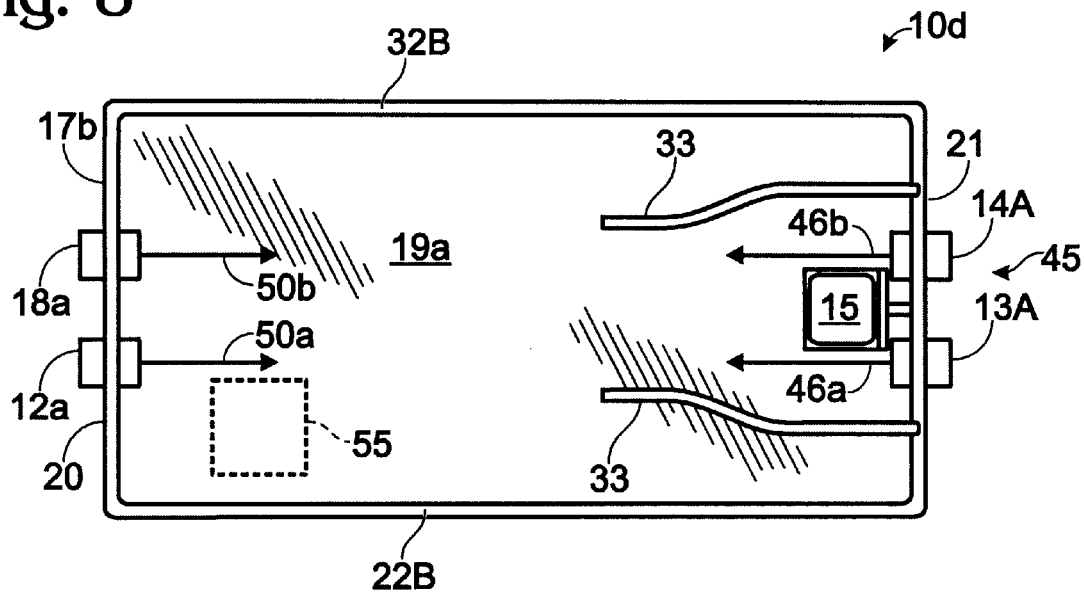
FIG. 8 illustrates the top view of an ice skating stationary deck used in one application of the preferred embodiment of the invention.
Figure 9:
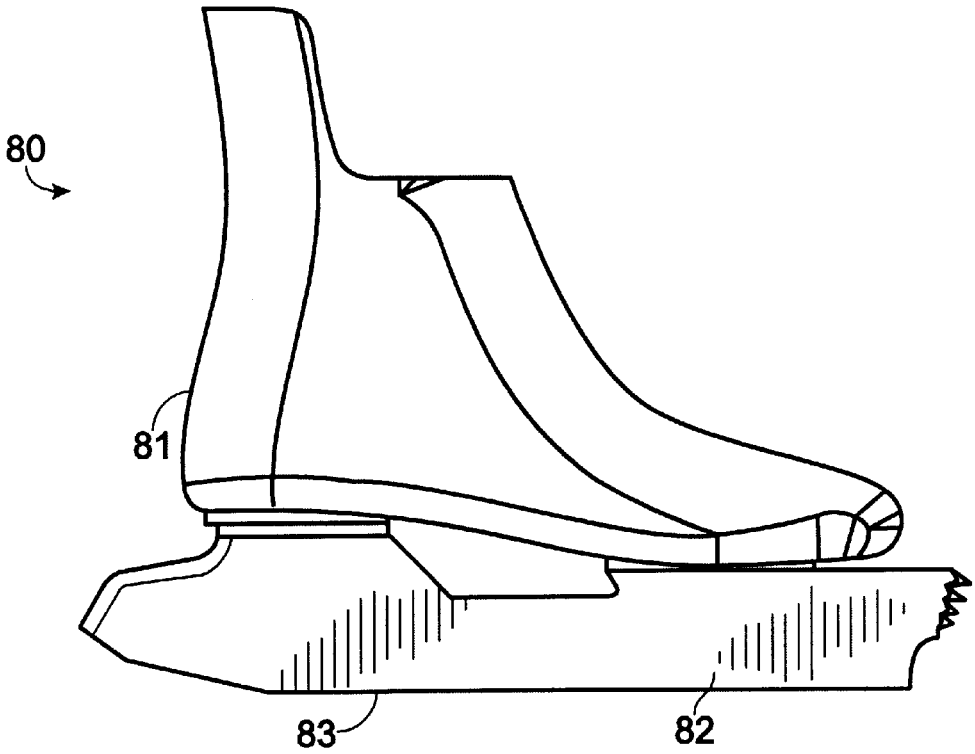
FIG. 9 shows a side view of an ice skate that is used in one application of the preferred embodiment of the invention.

If apparatus 10 is an ice skating treadmill, the endless belt 19 users a ultra high molecular weight (UHMW) polyethylene endless surface belt that is slightly less than the width of the treadmill platform 17. The endless belt 19 width for an ice skating exercise machine is usually about eight feet wide, but the width varies depending on the ice skating application. The ice skating endless belt 19 is typically wider than the running endless belt 19 to accommodate the sideward motion of an ice skating stride. Alternately, the ice skating treadmill is substitutable for an ice skating cover 19*c* using a stationary platform 17*c* as illustrated in FIG. 8 instead of the endless belt. Typically, the stationary platform surface 17*c* uses a cover 19*c* comprised of UHMW polyethylene. However, any high density plastic with UHMW polyethylene characteristics is substitutable for UHMW polyethylene for use as the material of construction for the endless belt 19 or cover 19*c*. The endless belt 19 and cover 19*c* are covered with a flexible UHMW polyethylene. Furthermore, the cover 19*c* surface is used in combination with the polytetrafluoroethylene coated ice skates 80 (FIG. 9) to provide a coefficient of friction similar to that of natural ice. The endless belt 19 or cover 17*c* are operated in conjunction with the user 23 wearing ice skates 80 having boots 81 and blades 83 that are polytetrafluoroethylene coated 82 as shown in FIG. 9.

When apparatus 10 is an ice skating treadmill the treadmill motor/drive 47 provides a variable endless belt 19 speed from about zero to 28 mph. The variable speed is accomplished by a potentiometer as is known by the practitioner in the art. However, the potentiometer is substitutable for a variable DC motor and hardware. This includes an AC to DC inverter so that the treadmill is conveniently plugged into any home 110 VAC outlet. A servo-motor is used to adjust the elevation of the endless belt 19 to provide the user 23 with the simulation of skating uphill. The user 23 regulates the speed and elevation of the endless belt 19 from the panel of the controlling means 15. The controlling means 15 allows the endless belt 19 to work in a forward movement and a backward movement and includes an AC to DC inverter and the necessary electrical devices. A forward movement allows the user 23 to exercise their leg muscles and stride simulating forward skating while the backward movement allows the user 23 to exercise their leg muscles and stride simulating reverse skating. The forward movement and backward movement is accomplished by a switch or other means located at the panel of the controlling means 15 reversing motor polarity through the proper electronic circuitry. Alternately, the endless belt 19 further consists of the proper mechanical connections with the motor 47 to allow the endless belt 19 to be freewheeling, that is, the endless belt will move independent of the motor 47. The endless belt 19 speed is variable with the forward movement and the backward movement. Finally, the endless belt 19 incline adjustment is located at the controlling means 15.

The multi-directional resistance means 45 changes to and from isotonic resistance and isokinetic resistance (constant force or maximum speed) by using the controlling means 15. In the preferred embodiment of the invention the multi-directional resistance means 45 and endless belt 19 speed and tilt are independently controlled. The multi-directional resistance means 45 consists of a first flywheel 13 and a second flywheel 14 (FIG. 7A) mounted at the front 21 of frame 11. The multi-directional resistance means 45 further includes a third flywheel 12 (FIG. 7A) and a fourth flywheel 18 mounted at the rear 20 of frame 11. Each multi-directional resistance means 45 not only includes a flywheel but further includes a magnetic brake, recoil and a one way clutch. The user 23 will be strapped to the four flywheels with four connection means by four points at front of their legs and by four points at the rear of their legs. For example, resistance is generated on the user's 23 right leg from the first flywheel 13 by the user 23 pulling their right leg backward away from the first flywheel 13 using the front right leg connection means 46*a*. At the same time as the user's 23 right leg moves away from the first flywheel 13 their right leg moves toward the third flywheel 12 (FIG. 7A), wherein the recoil of the third flywheel 12 coils the rear right leg connection means 50*a* (FIG. 3). In the next move, as the user 23 pulls their right leg away from the third flywheel 12 the resistance from the third flywheel 12 is applied to the user's 23 right leg using the rear right leg connection means 50*a* (FIG. 3). At the same time as the user's 23 right leg moves away from the third flywheel 12 their right leg moves back toward the first flywheel 13, wherein the recoil of first flywheel 13 coils the front right leg connection means 46*a*. Furthermore, the user's 23 left leg has resistance generated from the second flywheel 14 and the fourth flywheel 18 similar to the resistance generated for the user's right leg.

The magnetic brake is an electric particle magnet but is substitutable for one that is a hybrid with hysterisis and eddy flow. The magnetorheological device combines a rotary brake with a flywheel thereby providing resistance and rotational inertia. A rotor rotates around a stationary member of the rotary brake and supports the generation of a magnetic field. The resistance to rotation is generated and controlled by applying a magnetic field to a pole and a medium disposed between the rotor and stationary member. The amount of resistance from the multi-directional resistance means 45 is varied by the controlling means 15 through the appropriate electrical circuits. As an alternative, the multi-directional resistance means 45*a* is comprised of two flywheels as shown in apparatus 10*a* in FIG. 2.

The first, second, third and fourth flywheels are each connected to user 23 by the various connection means. The first flywheel 13 is connected by a front right leg connection means 46*a* to the front of the right leg and knee of user 23. The second flywheel 14 is connected by a front left leg connection means 46*b* to the front of the left leg and knee of user 23 as shown in FIG. 4. The third flywheel 12 is connected by a rear left leg connection means 50*b* to the back of the left leg and knee of user 23. Also, the fourth flywheel 18 is connected by a rear right leg connection means 50*a* to the back of the right leg and knee of user 23 as shown in FIG. 3.

In the apparatus 10 of FIG. 1, the multi-directional resistance means 45 is adjustable providing increased or decreased resistance to the users' leg muscles. First, the force (lbs.) of resistance or torque is adjustable in small increments by a switch, typically by a push of a button, located in the panel of the control means 15. The force of resistance is controlled by a constant force of resistance with no relationship to the speed or incline of the endless belt 19. Alternately, the force of resistance is controlled by a constant speed setting of the endless belt 19 with the force of resistance automatically adjusting to maintain a top maximum speed. However, the maximum speed may be set independently from the endless belt. A gauge that is located in the panel of the control means 15 will be able to record the force of resistance which the user is operating when the machine is in any mode of resistance.

The frame 11 of apparatus 10 is typically constructed of heavy gauge anodized aluminum. Other materials include, but are not limited to mild steel, stainless steel, plastic, and the like. Inside the treadmill platform 17 is mounted the treadmill motor/drive 47 and the required electrical circuitry including an inverter and transformer to convert 110 volts AC to 110 volts DC and 12 volts DC to operate the control means 15. The motor is either AC or DC depending on the application. The potentiometer, or as an alternative the variable DC drive, is also located inside the treadmill platform 17.

The endless belt 19 is attached to the sides of the treadmill platform 17 by means of take up bearing assemblies. The take up bearings are used to tension the endless belt 19. In the ice skating treadmill a deck of infused wood on a shock absorbing base is mounted along the length and inside of the platform 17. This provides a flat smooth bed that supports the entire endless belt 19 surface. The deck of infused wood is required because the width of the ice skating treadmill is typically about eight feet. In the running treadmill the endless belt 19 is supported by a smooth platform positioned underneath the belt and this gives the endless belt 19 a flat smooth bed on which to run. Finally, the controlling means 15 is mounted to the frame 11 by a mounting structure 16.

The treadmill apparatus 10 has a stomach pad and/or bicycle handle bar type supports for the front bar 33 located at the front 21. Furthermore, the treadmill apparatus 10 has a stomach pad or handle bar type supports at each side for the first side bar 22 and the second side bar 32. The front bar 33, the first side bar 22 and the second side bar 32 are used by user 23 as support on crossover strides of each leg on both side of the treadmill apparatus 10 and for the forward stride of each leg. Also, closed circuit cameras are mountable on the sides and rear 20 with the monitors visible to the user 23 in the front 21 of the treadmill 10 so that the user 23 can perfect and adjust their stride. Alternately, mirrors are substitutable for closed circuit cameras or can be used in conjunction with the closed circuits cameras for the user 23 to perfect their stride. Finally, the user will have a harness secured to them mounted on a frame that is built over the top of apparatus 10. The harness will secure the user 23, for example, when speed training at 28 mph, wherein the harness is for stopping the user 23 from flying off the treadmill 19.

The controlling means 15 includes the electrical, safety and operational controls of apparatus 10, including, but not limited to, the necessary relays and resistors for the system operation. The controlling means 15 includes a panel that incorporates main power switches, an emergency stop switch, a digital speed indicator, a heart rate monitor, and the like. For example, the controlling means 15 houses the electrical circuit to control the endless belt 19 in the forward movement and the backward movement when the treadmill 10 is an ice skating treadmill. The electrical circuit is operated by a switch mounted on the controlling means 15 panel. Resistance control for each flywheel in the form of a rotary switch or similar means is individually mounted on the controlling means 15 panel. As an alternative, one rotary switch or similar means provides the resistance control for all the flywheels. Further features include right and left endless belt 19 fault indicator lamps to indicate when the endless belt over tracks to one side. A drive fault indicator lamp is included to signal a drive problem. Also, a belt start/stop switch is used to activate the endless belt 19 while a rotary switch is used to select the desired speed of the belt. As is known by the practitioner in the art the rotary switches are replaceable by a digital system. Finally, the controlling means 15 allows the user 23 to individually regulate the resistance means 45 and the endless belt 19 speed to change the effect of the users' workout.

Figure 2:
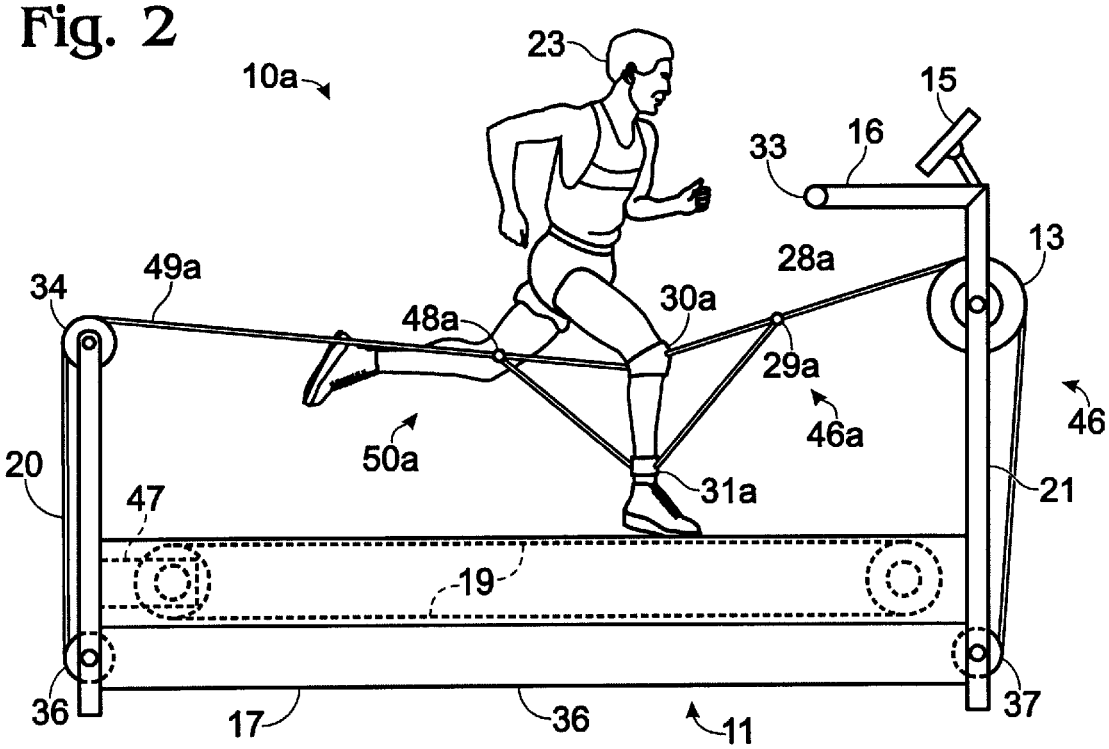
FIG. 2 shows a side view of the exercise apparatus using two flywheels as the resistance means in the preferred embodiment of the invention.

FIG. 2 shows an exercise treadmill apparatus 10*a* with two flywheels in the preferred embodiment of the invention. A frame 11 supports all the components of the treadmill apparatus 10*a*. This includes the treadmill platform 17, the endless belt 19, a multi-directional resistance means 45 and a front bar 33. The front bar 33 is for the user 23 to hold onto while strengthening their stride. The multi-directional resistance means 45 consists of two flywheels each containing a magnetic brake, recoil and a one-way clutch. The user 23 has the ability to operate the endless belt 19 in conjunction with the multi-directional resistance means 45. Alternately, the multi-directional resistance means 45 is independently controllable from the endless belt 19 control. A controlling means 15 provides the user 23 with the ability to speedup or slow down the endless belt 19 and incline or decline the endless belt 19. The controlling means 15 provides the user 23 with the ability to regulate the intensity of their workout by adjusting the amount of resistance produced from the multi-directional resistance means 45.

The treadmill apparatus 10*a* is adaptable to a variety of applications including, but not limited to, a running treadmill and an ice skating treadmill. If apparatus 10*a* is a running treadmill, the endless belt 19 uses a rubberized endless belt slightly less than the width of the treadmill platform 17. The rubberized polyester belt will contain parallel ridges from side-to-side of the belt all the way around the endless belt 19. The ridges will provide to the user a non-slip surface so that they may safely exercise using apparatus 10*a*. Belt tension on the endless belt 19 is adjustable on the treadmill as is known by the practitioner in the art. The treadmill platform 17 contains a motor/drive arrangement 47 that is typical in the art and mounted inside the treadmill platform 17. However, the motor/drive 47 provides an endless belt 19 speed from about zero to 28 mph. The user 23 regulates the speed of the endless belt 19 from the controlling means 15. The controller for the endless belt 19 typically is accomplished by use of a potentiometer as is common in the art. The endless belt 19 speed is also controlled by the use of a variable speed DC motor and hardware in other applications. Furthermore, a servo-motor as is typically used in the art adjusts the elevation (incline) of the endless belt 19 track. The user 23 regulates the speed and incline of the endless belt 19 from the panel of the controlling means 15.

If apparatus 10*a* is an ice skating treadmill, the endless belt 19 uses a ultra high molecular weight (UHMW) polyethylene endless surface belt slightly less than the width of the treadmill platform 17. The width of the ice skating treadmill platform 17 is typically about eight feet, but this width is substitutable for any width that is desired. Alternately, the endless belt is substitutable for a stationary platform 19*b* and cover 17*b* as shown in FIG. 8. The cover 17*b* on the stationary platform consists of UHMW polyethylene material. However, any high density plastic with UHMW characteristics is substitutable for the UHMW polyethylene material used in the construction of the endless belt 19 on the treadmill platform 17 and the cover 17*b* on the stationary platform 19*b*. The endless belt 19 on the treadmill platform 17 is covered with a flexible UHMW polyethylene. Furthermore, the endless belt 19 surface is used in combination with the polytetrafluoroethylene coated ice skates 80 (FIG. 9) to provide a coefficient of friction similar to that of natural ice. The endless belt 19 is used in conjunction with the user 23 wearing ice skates 80 with boots 81 and blades 83 that are polytetrafluoroethylene coated.

The controlling means 15 allows the endless belt 19 when operated as an ice skating treadmill to work in a forward movement and a backward movement. The controlling means 15 further includes an inverter and the necessary electrical devices. The forward movement allows the user 23 to exercise their stride simulating forward skating while the backward movement allows the user 23 to exercise their stride simulating reverse skating. Also, the controlling means 15 allows the endless belt 19 to speedup or slowdown using an adjustable motor/drive 47 to vary the speed. The variable speed is accomplished by a potentiometer as is known by the practitioner in the art. However, the potentiometer is substitutable for a variable DC motor and hardware. The forward movement and backward movement is accomplished by a switch or similar means located at the controlling means 15 panel that reverses motor polarity through electrical circuitry in the controlling means 15. The endless belt 19 speed is variable with the forward movement and the backward movement. The endless belt 19 is also operable on an incline with the forward and the backward movement.

The multi-directional resistance means 45 through the controlling means 45 works in conjunction with the endless belt 19 or independent of the endless belt 19. In the preferred embodiment of the invention the multi-directional resistance means 45 is controlled independently from the control of the endless belt 19. The multi-directional resistance means 45 consists of a first flywheel 13 and a second flywheel 14 (FIG. 7B) mounted at the front 21 of frame 11. Each multi-directional resistance means 45 consists of a flywheel that further includes a magnetic brake, recoil and a one way clutch. For example, resistance is generated on the user's 23 right leg from the first flywheel 13 by the user 23 pulling their right leg backward away from the first flywheel 13 using the front right leg connection means 46*a*. At the same time as the user's 23 right leg moves away from the first flywheel 13 their right leg moves toward the top right rear pulley 34, wherein the recoil of the first flywheel 13 coils the rear right leg connection means 50*a*. In the next move, as the user 23 pulls their right leg away from the top right rear pulley 34 the resistance from the first flywheel 13 is applied to the user's 23 right leg using the rear right leg connection means 50*a*. At the same time as the user's 23 right leg moves away from the first flywheel 13 their right leg moves back toward the top right rear pulley 34, wherein the recoil of the first flywheel 13 coils the front right leg connection means 46*a*. Furthermore, the user's 23 left leg has resistance generated from the second flywheel 14 (FIG. 7B) and a top left rear pulley 34*a* (FIG. 7B) similar to the resistance that is generated for the user's right leg.

The magnetic brake is an electric particle magnet but is substitutable by one that is a hybrid with hysterisis and eddy flow. The magnetorheological device combines a rotary brake with a flywheel thereby providing resistance and rotational inertia. A rotor rotates around a stationary member of the rotary brake and supports the generation of a magnetic field. The resistance to rotation is generated and controlled by applying a magnetic field to a pole and a medium disposed between the rotor and stationary member. The amount of resistance from the resistance means 45 is varied by the controlling means 15 through the appropriate electrical circuits. As an alternative, the resistance means 45 is comprised of four flywheels as is apparatus 10 in FIG. 1.

Figure 7B:
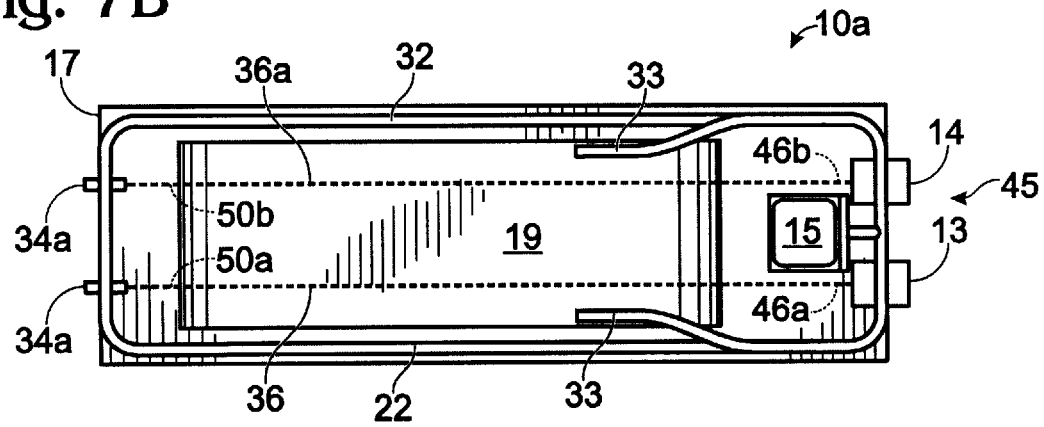
FIG. 7B illustrates the top view of the two flywheel application in the preferred embodiment of the invention.

The first flywheel 13 is connected to user 23 by the front right leg connection means 46*a* and a right third element 36 routed to the rear 20 and front 21. On the right side of the treadmill platform 17, the right third element 36 is guided by a right set of pulleys including the top right rear pulley 34, the bottom right rear pulley 35 and the bottom right front pulley 37. The front right leg connection means 46*a* includes connecting to the front of the right leg strap 31*a* and knee strap 30*a*, a right leg first element 28*a* and a right leg first rotatable structure 29*a*. The first flywheel 13 is also connected to the user 23 using the rear right leg connection means 50*a* at the rear of the right leg strap 31*a* and knee strap 30*a*. The rear right leg connection means 50*a* includes connection to the rear of the right leg strap 31*a* and the knee strap 30*a*, a right leg second element 49*a* and a right leg second rotatable structure 48*a*. The second flywheel 14 (FIG. 7B) is connected to the user 23*a* at the rear of the left leg by a rear left leg connection means 50*b* and at the front of the left leg by a front left leg connection means 46*b* as shown in FIG. 4. The rear left leg connection means 50*b* is connected to the second flywheel 14 and user 23 by a left knee strap 30*b*, a left leg strap 31*b*, a left leg second element 49*b* and a left leg rotatable structure 48*b*. The second flywheel 14 is connected to the left leg of user 23*a* by the left third element 36*a* (FIG. 7B) that is guided by a left side set of pulleys. The left set of pulleys are mounted in a similar fashion like the right side set of pulleys including the top left rear pulley 34*a* (FIG. 7B).

The frame 11 of apparatus 10*a* is typically constructed of heavy gauge anodized aluminum. Other materials include, but are not limited to, mild steel, stainless steel, plastic and the like. Inside the treadmill platform 17 is mounted the treadmill variable speed motor/drive 47 and the required electrical circuitry including a transformer and inverter to convert 110 volts AC to 110 volts DC and to 12 volts DC that operates the control means 15. The potentiometer, or as an alternative the variable DC drive, is also located inside the treadmill platform 17.

The endless belt 19 is attached to the sides of the platform 17 by means of take up bearing assemblies. The take up bearings are used to tension the endless belt of the treadmill 10*a*. In the ice skating treadmill a deck of infused wood on a shock absorbing base is mounted along the length and inside of the platform 17. This provides a flat smooth bed that supports the entire endless belt 19 surface. The deck of infused wood is required because the width of the ice skating treadmill is typically about eight feet. Finally, the controlling means 15 panel is mounted to the frame 11 by a mounting structure 16.

In the apparatus 10*a* of FIG. 2, the multi-directional resistance means 45 is adjustable providing increased or decreased resistance to the users' leg muscles. First, the force (lbs.) of resistance or torque is adjustable in small increments by a switch, typically by a push of a button, located in the panel of the control means 15. The force of resistance is controlled by a constant force of resistance with no relationship to the speed or incline of the endless belt 19. Alternately, the force of resistance is controlled by a constant speed setting of the endless belt 19 with the force of resistance automatically adjusting to maintain a top maximum speed. However, the maximum speed may be set independently from the endless belt. A gauge that is located in the panel of the control means 15 will be able to record the force of resistance which the user is operating when the machine is in any mode of resistance.

The controlling means 15 includes the electrical, safety and operational controls of apparatus 10*a*, including, but not limited to, the necessary relays and resistors for system operation. The controlling means 15 includes a panel that incorporates main power switches, an emergency stop switch, a digital speed indicator, a heart rate monitor and the like. For example, the controlling means 15 houses the inverter to convert from AC to DC and the electronic circuitry to control the endless belt 19 in the forward movement and the backward movement when the treadmill 10*a* is an ice skating treadmill. The forward and backward movement is operated by a switch mounted on the controlling means 15 panel. Resistance control in the form of a rotary switch or similar means, for each flywheel, are individually mounted on the controlling means 15 panel. As an alternative, one rotary switch or similar means provides the resistance control for all the flywheels. Further features include right and left endless belt 19 fault indicator lamps to indicate when the endless belt over tracks to one side. A drive fault indicator lamp is included to signal a drive problem. Also, a belt start/stop switch is used to activate the running belt while a rotary switch is used to select the desired speed of the belt. As is known by the practitioner in the art the rotary switches are replaceable by a digital system. Finally, the controlling means 15 allows the user 23 to regulate the resistance means 45 and the endless belt 19 speed to change the effect of the users' workout including raising and lowering the incline of the endless belt.

FIG. 3 shows a detailed view of the user's 23 right leg with the front right leg connection means 46*a* and the rear right leg connection means 50*a* in the preferred embodiment of the invention. The right leg of user 23 by means of the right knee strap 30*a* and the right leg strap 31*a* is connected to the first and the third flywheels or the first flywheel and the top right rear pulley. Alternately, the flywheel arrangement is substitutable for a hydraulic mechanism and would use the same right knee and leg strap. The front right leg connection means 46*a* consists of a right leg first element 28*a* that is connected by a right leg first rotatable structure 29*a*, which in turn connects to a right leg first segment 40*a* and a right leg second segment 39*a*. The right leg second segment 39*a* is connected to the right leg strap 31*a* in the front and the right leg first segment 40*a* is connected to the right knee strap 30*a* in the front. The right leg first element 28*a* is connected to a flywheel or hydraulic mechanism. The rear right leg connection means 50*a* consists of a right leg second element 49*a* connected to a flywheel or hydraulic mechanism and a right leg second rotatable structure 48*a*, which in turn connects to a right leg third segment 41*a* and a right leg fourth segment 42*a*. The third segment 41*a* is connected to the right knee strap 30*a* in the back and the fourth segment 42*a* is connected to the right leg strap 31*a* in the back. The left leg of user 23 is connected in a similar fashion like the right leg with a front left leg connection means 46*b* and a rear left leg connection means 50*b* (FIG. 4). The elements and segments are comprised of different items of construction including, but not limited to, rope, wire rope, wire, cable and stranded cable.

A detailed view of the user's 23 left leg with the front left leg connection means 46*b* and the rear left leg connection means 50*b* is shown in FIG. 4. The left leg of user 23 is connected to the second and fourth flywheel or to the second flywheel and top left rear pulley arrangement. Alternately, the flywheel arrangement is substitutable for a hydraulic mechanism arrangement (FIG. 6) that would use the same left knee and leg strap as the flywheel arrangement. The front left leg connection means 46*b* consists of a first element 28*b* that is connected by a first rotatable structure 29*b*, which in turn connects to a first segment 40*b* and a second segment 39*b*. The second segment 39*b* is connected to the right leg strap 31*b* at the front and the first segment 40*b* is connected to the left knee strap 30*b* at the front. The first element 28*b* is connected to either a flywheel or hydraulic mechanism. The rear left leg connection means 50*b* consists of a second element 49*b* connected to either a flywheel or hydraulic mechanism and a second rotatable structure 48*b*, which in turn connects to a third segment 41*b* and a fourth segment 42*b*. The third segment 41*b* is connected to the left knee strap 30*b* at the back and the fourth segment 42*b* is connected to the left leg strap 31*b* at the back. The right leg of user 23 is connected in a similar fashion like the left leg with a front right leg connection means 46*a* and a rear right leg connection means 50*a* (FIG. 3). The elements and segments are comprised of different items of construction including, but not limited to, rope, wire rope, wire, cable and stranded cable.

Figure 5:
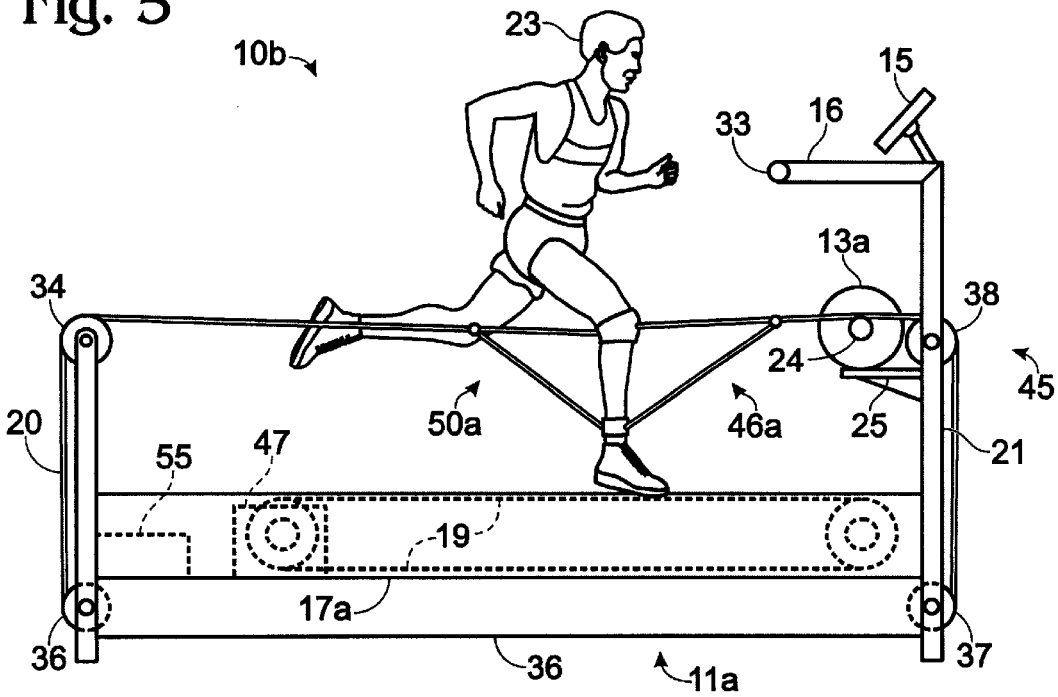
FIG. 5 shows a side view of the exercise apparatus using two hydraulic mechanisms as the resistance means in the preferred embodiment of the invention.

FIG. 5 illustrates treadmill apparatus 10*b* in the preferred embodiment of the invention. The apparatus 10*b* includes a multi-directional resistance means 45 that consists of two hydraulic mechanisms using fluid in a hydraulic circuit with a reservoir 55 and an adjustable orifice control valve 13*e* (FIG. 6A) to create and adjust the amount of the resistance. The hydraulic reservoir 55 is mounted toward the rear 20 of apparatus 10*b*. The switch for the adjustable orifice control valve 13*e* is located in the panel of the controlling means 15 mounted on the mounting structure 16. The first hydraulic mechanism 13*a* is mounted on frame 11*a* at the front 21. The second hydraulic mechanism 14*a* (FIG. 7C) is mounted on frame 11*a* at the front 21. As an option the first hydraulic mechanism 13*a* and the second hydraulic mechanism 14*a* may be mounted at the rear 20 of frame 11. In an event, the height of these two hydraulic mechanisms will be adjustable as will their rotation position relative to the user 23. Alternately, four hydraulic mechanisms 13*a*, 14*a*, 12*a* and 18*a* are used as the multi-directional resistance means 45 as shown in FIG. 7C. The hydraulic mechanisms are positioned on the frame 11, similarly as to the location of the flywheel arrangements, and include a one-way clutch and recoil mechanism. For example, a four hydraulic mechanism treadmill will have two hydraulic mechanisms, 13*a* and 14*a*, mounted on the front 21 of the treadmill apparatus 10*b*. The other two hydraulic mechanisms, 12*a* and 18*a*, are mounted at the rear 20 of treadmill apparatus 10*b*. The hydraulic circuitry and reservoir 55 will be located inside the treadmill platform 17*a*. All hydraulic mechanisms will be connected to the same hydraulic reservoir 55. Finally, the multi-directional resistance means 45 will provide one-way resistance and then recoil back with the opposite resistance on the other half of the users' 23 stride. This will strengthen their leg muscles and duplicate athletic procedures as the user 23 holds the front bar 33 of the treadmill apparatus 10*b*.

The apparatus 10*b* contains an endless belt 19 that has a variable speed from about zero to 28 mph. The endless belt 19 is adjustable in height allowing the endless belt to incline relative to the treadmill platform 17*a*. This provides the user 23 with the simulation of the resistance of exercising up a hill. The treadmill 10*b* contains a motor/drive 47 arrangement mounted inside the treadmill platform 17*a* as is typical in the art. Furthermore, a servo-motor is used to adjust the elevation of the endless belt 19. The user 23 regulates the speed and elevation of the endless belt 19 from the controlling means 15 panel. The speed control for the treadmill apparatus 10*b* typically is accomplished by use of a potentiometer as is known by the practitioner in the art. However, the treadmill 10*b* speed is also controllable by the use of a variable speed DC motor and hardware in other applications. This includes an AC to DC inverter so that the treadmill is conveniently plugged into any home 110 VAC outlet.

The first hydraulic mechanism 13*a* is connected to the front right leg by the front right leg connection means 46*a*, the rear right leg by the rear right leg connection means 50*a* and mounted to the frame 11*a* by a first base 25. Similarly, the second hydraulic mechanism 14*a* is connected to the left leg by the front left leg connection means 46*b*, the rear left by the left leg connection means 50*b* and mounted to the frame 11*a* by a second base 25*a* (FIG. 7C). This allows the user 23 to increase the strength of their lower extremities and stride when using the treadmill apparatus 10*b*.

The multi-directional resistance means 45 works in conjunction with the endless belt 19 or independent of the endless belt 19 through the controlling means 15. In the preferred embodiment of the invention the multi-directional resistance means 45 is independently operated from the operation of the endless belt 19. The multi-directional resistance means 45 consists of a first hydraulic mechanism 13*a* and a second hydraulic mechanism 14*a* (FIG. 7C) mounted at the front 21 of frame 11. In another embodiment the first and second hydraulic mechanism can be mounted in the rear 20 of frame 11. Each multi-directional resistance means 45 consists of a hydraulic mechanism, a spool with a recoil spring and a one-way clutch. For example, resistance is generated on the user's 23 right leg from the first hydraulic mechanism 13*a* by the user 23 pulling their right leg backward away from the first hydraulic mechanism 13*a* using the front right leg connection means 46*a*. At the same time as the user's 23 right leg moves away from the first hydraulic mechanism 13*a* their right leg moves toward the top right rear pulley 34, wherein the recoil of the first hydraulic mechanism 13*a* coils the rear right leg connection means 50*a*. In the next move, as the user 23 pulls their right leg away from the top right rear pulley 34 the resistance from the first hydraulic mechanism 13*a* is applied to the user's 23 right leg using the rear right leg connection means 50*a*. At the same time as the user's 23 right leg moves away from the first hydraulic mechanism 13*a* their right leg moves back toward the top right rear pulley 34, wherein the recoil of first hydraulic mechanism 13 coils the front right leg connection means 46*a*. Furthermore, the user's 23 left leg has resistance generated from the second hydraulic mechanism 14*a* (FIG. 7C) and a top left rear pulley 34*a* (FIG. 7C) similar to the resistance generated for the user's right leg. As another alternative, the resistance means 45 is comprised of four hydraulic mechanisms as is apparatus 10*c* (FIG. 7C).

Figure 5A:
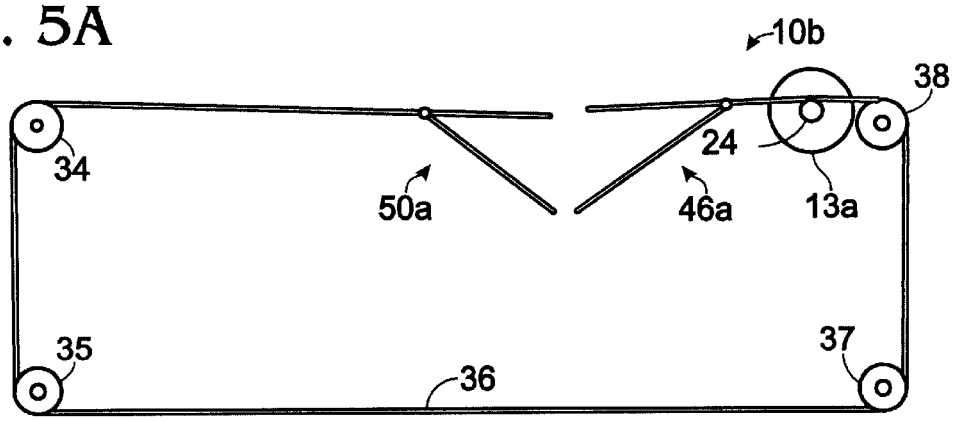
FIG. 5A illustrates the right side pulley set in the preferred embodiment of the invention.
Figure 5B:
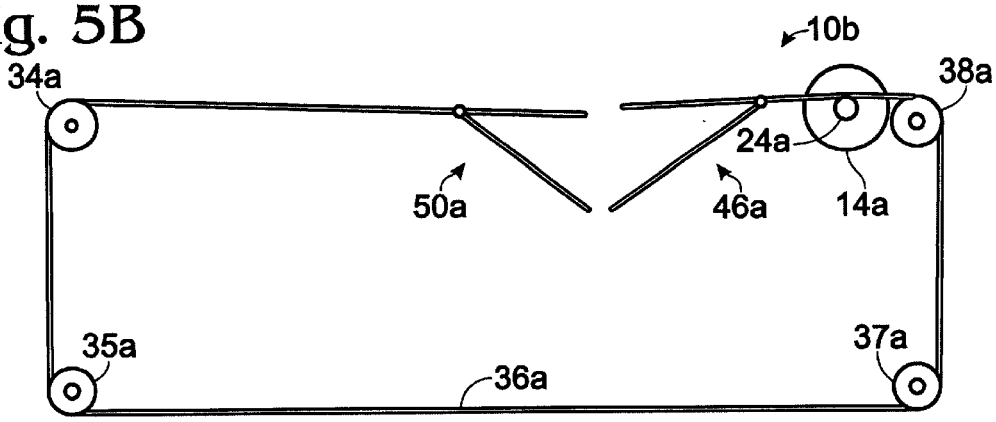
FIG. 5B illustrates the left side pulley set in the preferred embodiment of the invention.

The first hydraulic mechanism 13*a*, as shown in FIG. 5A, is connected to user 23 by the front right leg connection means 46*a*, a rear right leg connection means 50*a* and a right third element 36 routed to the rear 20 and front 21. The first hydraulic mechanism 13*a* provides directed resistance through the first sprocket 24 in communication with the front right leg connection means 46*a* and the right third element 36. The right third element 36 is guided by a right set of pulleys including the top right rear pulley 34, the bottom right rear pulley 35, the bottom right front pulley 37 and the top right front pulley 38 on the right side of the treadmill apparatus 10*b*. The second hydraulic mechanism 14*a*, as shown in FIG. 5B, is connected to the user 23 to the rear of the left leg by a rear left leg connection means 50*b* and to the front of the left leg by a front left leg connection means 46*b*. The second hydraulic mechanism 14*a* provides directed resistance through the second sprocket 24*a* in communication with the front left leg connection means 46*b* and the left third element 36*a*. The second hydraulic mechanism 14*a* is connected to the left leg of user 23 by the left third element 36*a* guided by a left side set of pulleys. This includes the top left rear pulley 34*a*, the bottom left rear pulley 35*a*, the bottom left front pulley 38 and the top left front pulley 38*a* on the left side of the treadmill apparatus 10*b*.

The frame 11*a* of apparatus 10*b* is typically constructed of heavy gauge anodized aluminum. Other materials include, but are not limited to, mild steel, stainless steel, plastic and the like. Inside the treadmill platform 17*a* is mounted the variable speed motor/drive 47 and the required electrical circuitry including a transformer and inverter to convert 110 volts AC to 110 volts DC and 12 volts DC to operate the control means 15. The potentiometer, or as an alternative the variable DC drive, is also located inside the treadmill platform 17*a*. The endless belt 19 is attached to the sides of the platform 17*a* by means of take up bearing assemblies. The take up bearings are used to tension the endless belt of the treadmill 10*b*. In the ice skating treadmill there are three to five rows of support rollers that are mounted along the length and inside of the platform 17*a* to provide support for the entire endless belt 19 surface. They are staggered to give the endless belt a flat smooth bed on which to run. This is because the endless belt 19 in an ice skating treadmill is typically about eight feet in width. In the running treadmill the endless belt 19 is supported by a smooth platform positioned underneath the belt and this gives the endless belt a flat smooth bed on which to run. Finally, the controlling means 15 panel is mounted to the frame 11*a* by a mounting structure 16.

In the apparatus 10*b* of FIG. 5, the multi-directional resistance means 45 is adjustable providing increased or decreased resistance to the users' leg muscles. First, the force (lbs.) of resistance or torque is adjustable in small increments by a switch, typically by a push of a button, located in the panel of the control means 15. The force of resistance is controlled by a constant force of resistance with no relationship to the speed or incline of the endless belt 19. Alternately, the force of resistance is controlled by a constant speed setting of the endless 19 with the force of resistance automatically adjusting to maintain an optimum speed. A gauge positioned in the panel of the control means 15 will be able to record the force of resistance which the user is operating when the machine is in any speed mode of resistance.

The controlling means 15 includes the electrical, safety and operational controls of the treadmill apparatus 10*b*, including, but not limited to, the necessary relays and resistors for system operation. The controlling means 15 includes a panel that incorporates main power switches, an emergency stop switch, a digital speed indicator, a heart rate monitor and the like. For example, the controlling means 15 houses the inverter to convert from AC to DC and the electronic circuitry to control the endless belt 19 in the forward movement and the backward movement when the treadmill 10*b* is an ice skating treadmill. The forward and backward movement is operated by a switch mounted on the controlling means 15 panel. Resistance control in the form of a rotary switch or similar means, for each flywheel, are individually mounted on the controlling means 15 panel. As an alternative, one rotary switch or similar means provides the resistance control for all the flywheels. Further features include right and left endless belt 19 fault indicator lamps to indicate when the endless belt over tracks to one side. A drive fault indicator lamp is included to signal a drive problem. Also, a belt start/stop switch is used to activate the running belt while a rotary switch is used to select the desired speed of the belt. As is known by the practitioner in the art the rotary switches are replaceable by a digital system. Finally, in the controlling means 15 the force of resistance is controlled by a constant force of resistance with no relationship to the speed or incline of the endless belt 19. Alternately, the force of resistance is controlled by a constant speed setting of the endless belt 19 with the force of resistance automatically adjusting to maintain a top maximum speed. However, the maximum speed may be set independently from the endless belt. A gauge that is located in the panel of the control means 15 will be able to record the force of resistance which the user is operating when the machine is in any mode of resistance.

the user 23 to regulate the resistance means 45 and the endless belt 19 speed to change the effect of the users' workout including raising and lowering the incline of the endless belt.

FIGS. 6A, 6B, 6C and 6D illustrate the multi-directional resistance means 45 with the various hydraulic mechanisms in the preferred embodiment of the invention.

Figure 6A:
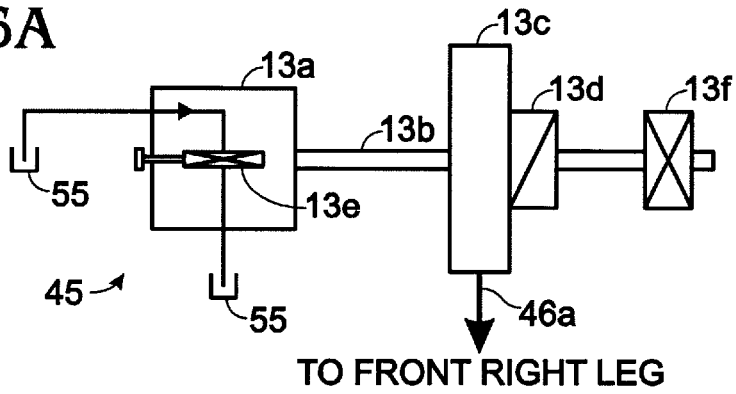
FIG. 6A illustrates the front right leg connection means and a hydraulic mechanism in the preferred embodiment of the invention.
Figure 7C:
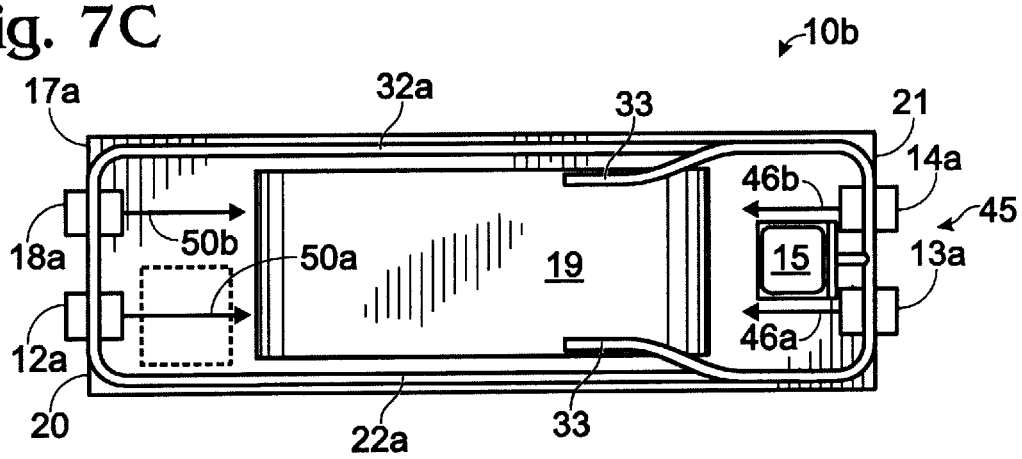
FIG. 7C illustrates the top view of the four hydraulic mechanism application in the preferred embodiment of the invention.

FIG. 6A shows that the first hydraulic mechanism 13*a* is in communication with the first shaft 13*b*. The first shaft 13*b* is in communication with the first recoil spool 13*c*, the first one-way clutch 13*d* and the first pillow block bearing 13*f*. A first adjustable orifice control 13*e*, that is integral with the first hydraulic mechanism 13*a*, increases or decreases the flow to and from the reservoir 55 by increasing or decreasing the opening of the orifice. Increasing or decreasing the opening of the orifice, by adjusting the adjustable orifice 13*e*, will accordingly increase or decrease the amount of resistance obtained from the first hydraulic mechanism 13*a*. The first hydraulic mechanism 13*a* provides resistance when the front right leg connection means 46*a* is being pulled out of the first recoil spool 13*c* and is freewheeling (no resistance) when the first recoil spool 13*c* coils the front right leg connection means 46*a*. The recoil is accomplished by a spring that is part of the first recoil spool 13*c* and the first one-way clutch 13*d*. Alternately, the first one way clutch 13*d* is substitutable for a one-way bearing. When the front right leg connection means 46*a* is pulled out of the first recoil spool 13*c* the first one-way clutch 13*d* engages the first shaft 13*b* which communicates with the first hydraulic mechanism 13*a*. As the first shaft 13*b* turns, it moves hydraulic fluid through the first adjustable orifice (hole) control 13*e* that is integrally a part of the first hydraulic mechanism 13*a* creating the resistance. The resistance is increased or decreased by adjusting the first adjustable orifice control 13*e*. At the same time, the front right leg connection means 46*a* is being pulled out from (away from) the first recoil spool 13*c* and turning the first shaft 13*b*, the spring in the first recoil spool 13*c* is winding tighter. When the right leg moves into (toward) the first recoil spool 13*c*, the spring in the first recoil spool 13*c* retrieves the front right leg connection means 46*a*. There is no resistance when the front right leg connection means 46*a* is retrieved because the first one-way clutch 13*d* disengages the first shaft 13*b* from the first hydraulic mechanism 13*d*, wherein the first hydraulic mechanism does not turn.

Figure 6B:
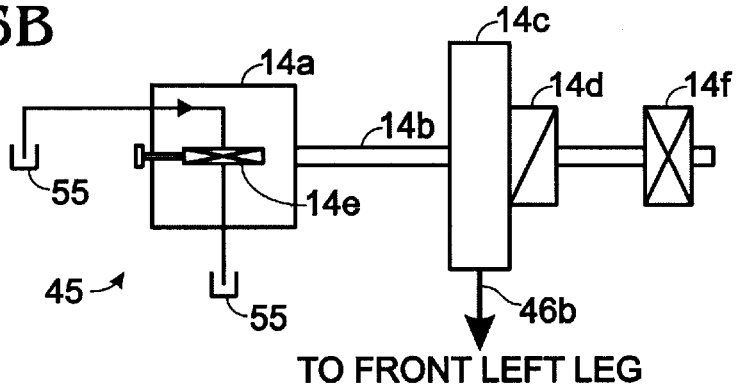
FIG. 6B illustrates the front left leg connection means and a hydraulic mechanism in the preferred embodiment of the invention.

FIG. 6B shows that the second hydraulic mechanism 14*a* is in communication with the second shaft 14*b*. The second shaft 14*b* is in communication with the second recoil spool 14*c*, the second one-way clutch 14*d* and the second pillow block bearing 14*f*. A second adjustable orifice control 14*e* that is integral with the second hydraulic mechanism 14*a* increases or decreases the flow to and from the reservoir 55 by increasing or decreasing the opening of the orifice. Increasing or decreasing the opening of the orifice, by adjusting the first adjustable orifice, will accordingly increase or decrease the amount of resistance obtained from the second hydraulic mechanism 14*a*. The second hydraulic mechanism 14*a* provides resistance when the front left leg connection means 46*b* is being pulled out of the second recoil spool 14*c* and is freewheeling (no resistance) when the second recoil spool 14*c* coils the front left leg connection means 46*b*. The recoil is accomplished by a spring that is part of the second recoil spool 14*c* and the second one-way clutch 14*d*. Alternately, the second one way clutch 14*d* is substitutable for a one-way bearing. When the front left leg connection means 46*b* is pulled out of the second recoil spool 14*c* the second one-way clutch 14*d* engages the second shaft 14*b* which communicates with the second hydraulic mechanism 14*a*. As the second shaft 14*b* turns, it moves hydraulic fluid through the second adjustable orifice (hole) control 14*e* that is integrally a part of the second hydraulic mechanism 14*a* creating the resistance. The resistance is increased or decreased by adjusting the second adjustable orifice control 14*e*. At the same time, as the front left leg connection means 46*b* is being pulled out from (away from) the second recoil spool 14*c* and turning the second shaft 14*b* the spring in the second recoil spool 14*c* is winding tighter. When the left leg moves into (toward) the second recoil spool 14*c* the spring in the second recoil spool 14*c* retrieves the front left leg connection means 46*b*. There is no resistance when the front left leg connection means 46*b* is retrieved because the second one-way clutch 14*d* disengages the second shaft 14*b* from the second hydraulic mechanism 14*d*, wherein the second hydraulic mechanism does not turn.

Figure 6C:
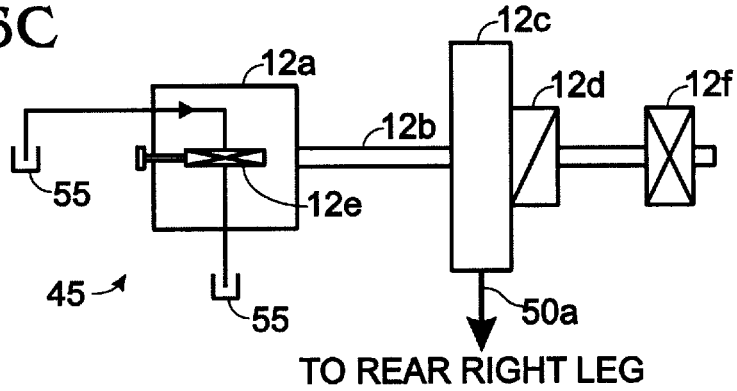
FIG. 6C illustrates the rear right leg connection means and a hydraulic mechanism in the preferred embodiment of the invention.

FIG. 6C shows that the third hydraulic mechanism 12*a* is in communication with the third shaft 12*b*. The third shaft 12*b* is in communication with the third recoil spool 12*c*, the third one-way clutch 12*d* and the third pillow block bearing 12*f*. A third adjustable orifice control 12*e*, that is integral to the third hydraulic mechanism 12*a*, increases or decreases the flow to and from the reservoir 55 by increasing or decreasing the opening of the orifice. Increasing or decreasing the opening of the orifice, by adjusting the third adjustable orifice 12*e*, will accordingly increase or decrease the amount of resistance obtained from the third hydraulic mechanism 12*a*. The third hydraulic mechanism 12*a* provides resistance when the rear right leg connection means 50*a* is being pulled out of the third recoil spool 12*c* and is freewheeling (no resistance) when the third recoil spool 12*c* coils the rear right leg connection means 50*a*. The recoil is accomplished by a spring that is part of the third recoil spool 12*c* and the third one-way clutch 12*d*: Alternately, the third one way clutch 12*d* is substitutable for a one-way bearing. When the rear right leg connection means 50*a* is pulled out of the third recoil spool 12*c* the third one-way clutch 12*d* engages the third shaft 12*b*, which communicates with the third hydraulic mechanism 12*a*. As the third shaft 12*b* turns it moves hydraulic fluid through the third adjustable orifice (hole) control 12*e* that is integrally a part of the third hydraulic mechanism 12*a* creating the resistance. The resistance is increased or decreased by adjusting the third adjustable orifice control 12*e*. At the same time, as the rear right leg connection means 50*a* is being pulled out from (away from) the third recoil spool 12*c* and turning the third shaft 12*b* the spring in the third recoil spool 12*c* is winding tighter. When the right leg moves into (toward) the third recoil spool 12*c* the spring in the third recoil spool 12*c* retrieves the rear right leg connection means 50*a*. There is no resistance when the rear right leg connection means 50*a* is retrieved because the third one-way clutch 12*d* disengages the third shaft 12*b* from the third hydraulic mechanism 12*d*, wherein the third hydraulic mechanism does not turn.

Figure 6D:
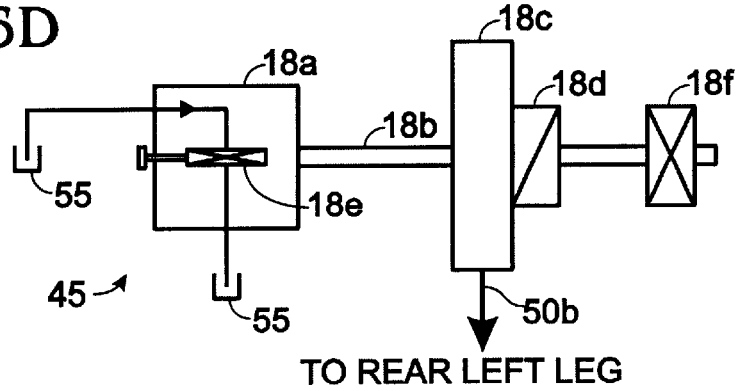
FIG. 6D illustrates the rear left leg connection means and a hydraulic mechanism in the preferred embodiment of the invention.

FIG. 6D shows that the fourth hydraulic mechanism 18*a* is in communication with the fourth shaft 18*b*. The fourth shaft 18*b* is in communication with the fourth recoil spool 18*c*, the fourth one-way clutch 18*d* and the fourth pillow block bearing 18*f*. A fourth adjustable orifice control 18*e*, that is integral to the fourth hydraulic mechanism 18*a*, increases or decreases the flow to and from the reservoir 55 by increasing or decreasing the opening of the orifice. Increasing or decreasing the opening of the orifice, by adjusting the fourth adjustable orifice 14*e*, will accordingly increase or decrease the amount of resistance obtained from the fourth hydraulic mechanism 18*a*. The fourth hydraulic mechanism 18*a* provides resistance when the rear left leg connection means 50*b* is being pulled out of the fourth recoil spool 18*c* and is freewheeling (no resistance) when the fourth recoil spool 18*c* coils the rear left leg connection means 50*b*. The recoil is accomplished by a spring that is part of the fourth recoil spool 18*c* and the fourth one-way clutch 18*d*. Alternately, the fourth one way clutch 18*d* is substitutable for a one-way bearing. When the rear left leg connection means 50*b* is pulled out of the fourth recoil spool 18*c* the fourth one-way clutch 18*d* engages the fourth shaft 18*b* which communicates with the fourth hydraulic mechanism 18*a*. As the fourth shaft 18*b* turns, it moves hydraulic fluid through the fourth adjustable orifice (hole) control 18*e* that is integrally a part of the fourth hydraulic mechanism 18*a* creating the resistance. The resistance is increased or decreased by adjusting the fourth adjustable orifice control 18*e*. At the same time, as the rear left leg connection means 50*b* is being pulled out from (away from) the fourth recoil spool 18*c* and turning the fourth shaft 18*b* the spring in the fourth recoil spool 18*c* is winding tighter. When the left leg moves into (toward) the fourth recoil spool 18*c* the spring in the fourth recoil spool 18*c* retrieves the rear left leg connection means 50*b*. There is no resistance when the rear left leg connection means 50*b* is retrieved because the fourth one-way clutch 18*d* disengages the fourth shaft 18*b* from the fourth hydraulic mechanism 18*d*, wherein the fourth hydraulic mechanism does not turn.

The amount and kind of resistance produced from the first, second, third and fourth hydraulic mechanisms will be the result of the controlling means 15 adjusting and regulating the adjustable orifice control for each hydraulic mechanism. The controlling means 15 will allow the treadmill apparatus 10*c* (FIG. 7C) to remotely control the hydraulic mechanisms switching them between isokinetic resistance and isotonic resistance (constant force or maximum speed). As is known by the practitioner in the art, the appropriate electronic circuitry will be located in the panel of the controlling means 15 to adjust and regulate the various adjustable orifice controls in each hydraulic mechanism.

FIG. 7A shows the top view of treadmill apparatus 10 in the preferred embodiment of the invention using a four flywheel arrangement. The multi-directional resistance means 45 consists of the first flywheel 13 and the second flywheel 14 arrangement that is mounted at the front 21 of the treadmill platform 17 of the apparatus 10. The controlling means 15 panel is mounted at the front 21 of the apparatus 10. A user will operate the apparatus 10 engaging and adjusting the speed of the endless belt 19 from the controlling means 15 panel. There is a mechanism to disengage the endless belt 19 from its motor/drive arrangement 47 to allow the endless belt to move freely without the resistance caused by the motor/drive arrangement. The user will hold onto the front bar 33 and duplicate athletic procedures with the left side bar 32 and the right side bar 22. As a safety feature, the user can be strapped into a harness secured to a harness frame connected to the treadmill platform 17 when the speed of the endless belt 19 is fast. The multi-directional resistance means 45 further consists of a third flywheel 12 and the fourth flywheel 18 arrangement that is mounted at the rear 20 of the treadmill platform 17 of the apparatus 10. The front right leg connection means 46*a* communicates with the first flywheel 13 and the front left leg connection means 46*b* communicates with the second flywheel 14. Finally, the rear right leg connection means 50*a* communicates with the third flywheel 12 and the rear left leg connection means 50*b* communicates with the fourth flywheel 18.

FIG. 7B shows the top view of treadmill apparatus 10*a* in the preferred embodiment of the invention using a two flywheel arrangement. The multi-directional resistance means 45*a* consists of the first flywheel 13 and the right flywheel 14 arrangement that is mounted at the front 21 of the treadmill platform 17 of the apparatus 10*a*. Alternately, the first and second flywheel can be mounted in the rear 20 of the treadmill apparatus 10*a* The controlling means 15 panel is mounted at the front 21 of the apparatus 10*a*. A user will operate the apparatus 10*a* engaging and adjusting the speed of the endless belt 19 from this panel. There is a mechanism to disengage the endless belt 19 from its motor/drive arrangement 47 to allow the endless belt to move freely without the resistance caused by the motor/drive arrangement. The user will hold onto the front bar 33 and duplicate athletic procedures with the left side bar 32 and the right side bar 22. As a safety feature, the user can be strapped into a harness secured to a harness frame connected to the treadmill platform 17 when the speed of the endless belt 19 is fast. The user is connected to the right flywheel 13*a* arrangement by the front right leg connection means 46*a*, the rear right leg connection means 50*a* and a right third element 36. The right third element 36 is guided by a set of right pulleys including the top right rear pulley 34, the bottom right rear pulley 35 and the bottom right front pulley 37. Similarly, the user is connected to the left flywheel 14*a* arrangement by the front left leg connection means 46*b*, the rear left leg connection means 50*b* and a left third element 36*a*. The left third elements 36*a* is guided by a set of left pulleys including the top left rear pulley 34*a*, the bottom left front pulley 37*a* and the bottom left rear pulley 35*a*.

FIG. 7C shows the top view of the treadmill apparatus 10*c* in the preferred embodiment of the invention using a four hydraulic mechanism arrangement. The multi-directional resistance means 45 consists of the first hydraulic mechanism 13*a* and the second hydraulic mechanism 14*a* arrangement that are mounted at the front 21 of the treadmill platform 17*a* of the apparatus 10*c*. The third hydraulic mechanism 12*a* and the fourth hydraulic mechanism 18*a* arrangement are mounted at the rear 20 of the treadmill platform 17*a* of the apparatus 10*c*. The hydraulic reservoir 55 is mounted in the treadmill platform 17*a* toward the rear 20. The controlling means 15 panel is mounted at the front 21 of the apparatus 10*c*. A user will operate the apparatus 10*c* engaging and adjusting the speed of the endless belt 19 from this panel. There is a mechanism to disengage the endless belt 19 from its motor/drive arrangement 47 to allow the endless belt to move freely without the resistance caused by the motor/drive arrangement. The user will hold onto the front bar 33 and duplicate athletic procedures with the left side bar 32*a* and the right side bar 22*a*. As a safety feature, the user can be strapped into a harness secured to a harness frame connected to the treadmill platform 17*a* when the speed of the endless belt 19 is fast. The front right leg connection means 46*a* communicates with the first hydraulic mechanism 13*a* and the front left leg connection means 46*b* communicates with the second hydraulic mechanism 14*a*. Finally, the rear right leg connection means 50*a* communicates with the third hydraulic mechanism 12*a* and the rear left leg connection means 50*b* communicates with the fourth hydraulic mechanism 18*a*.

FIG. 8 shows the top view of the stationary apparatus 10*d* which is the stationary platform 17*b* arrangement of the preferred embodiment of the invention. This stationary apparatus 10*d* is used to simulate ice skating procedures. The multi-directional resistance means 45 consists of the first hydraulic mechanism 13*a* and the second hydraulic mechanism 14*a* arrangement that are mounted at the front 21 of the stationary platform 17*b* of the stationary apparatus 10*d*. The controlling means 15 panel is mounted at the front 21 of the apparatus 10*d*. The user will hold onto the front bar 33 and duplicate athletic procedures with the left side bar 32*b* and the right side bar 22*b*. The third hydraulic mechanism 12*a* and the fourth hydraulic mechanism 18*a* arrangement are mounted at the rear 20 of the stationary platform 17*b* of the apparatus 10*d*. The hydraulic reservoir 55 is mounted in the stationary platform 17*b* toward the rear 20.

The stationary platform 17*b* is typically about eight feet wide so that a user has the ability to duplicate actual ice skating procedures. To accomplish this, the cover 19*a* is positioned on top of the stationary platform 17*b* and typically is constructed of UHMW polyethylene material. However, other material is substitutable for the UHMW polyethylene, including but not limited to, any high density plastic material that is flexibly strong and in combination with the ice skates 80 provides a coefficient of friction similar to that of ice. Alternately, the eight feet of width of the stationary platform 17*b* and cover 19*a* is substitutable for smaller or larger size that will allow an athlete to duplicate the desired ice skating procedures. In any event, the apparatus 10*d* is used with ice skates 80 as shown in FIG. 9. The ice skates 80 include the boots 81 and the polytetrafluoroethylene 83 covering of the blades 82. The use of the ice skates 80 along with the cover 19*a* provides a low coefficient of friction that allows the user of apparatus 10*d* to duplicate ice skating procedures.

While there has been illustrated and described what is at present considered to be the preferred embodiment of the invention, it should be appreciated that numerous changes and modifications are likely to occur to those skilled in the art. It is intended in the appended claims to cover all those changes and modifications that fall within the spirit and scope of the present invention.

What is claimed is:

1. An exercise apparatus comprising:

a frame for supporting all the components of said apparatus;

a multi-directional resistance means for providing a user of said apparatus the ability to duplicate actual athletic procedures;

a treadmill for said user to operate in conjunction with said multi-directional resistance means;

a connection means between at least two legs of said user and said multi-directional resistance means;

a front bar for said user to hold onto while strengthening said users' stride; and a controlling means for adjusting said multi-directional resistance means, wherein the adjusting changes the effect of the users' workout.

2. The apparatus as claimed in claim 1, wherein said frame further includes a first sidebar and a second sidebar.

3. The apparatus as claimed in claim 1, wherein said multi-directional resistance means further comprises at least two flywheels each with a magnetic brake, a recoil and a one way clutch.

4. The apparatus as claimed in claim 3, wherein said magnetic brake is selected from the group consisting of an electric particle magnet and a hybrid with a hysterisis eddy flow.

5. The apparatus as claimed in claim 1, wherein said treadmill further consists of a motor providing a speed from stop to about 28 mph.

6. The apparatus as claimed in claim 1, wherein said treadmill further consists of an endless belt constructed of UHMW polyethylene material, a forward movement, a backward movement and an adjustable motor providing a variable speed.

7. The apparatus as claimed in claim 1, wherein said connection means further consists of an element, a rotatable structure and two segments with one connecting to a knee strap and the other connecting to a leg strap.

8. The apparatus as claimed in claim 1, wherein said multi-directional resistance means further consists of a first flywheel and a second flywheel mounted at the front of said frame.

9. The apparatus as claimed in claim 1, wherein said multi-directional resistance means further consist of a first and second flywheel mounted at the front of said frame and a third and fourth flywheel mounted at the rear of said frame.

10. The apparatus as claimed in claim 8, wherein said first flywheel is connected to the front of the right leg of said user by said connection means and said second flywheel is connected to the front of the left leg of said user by said connections means.

11. The apparatus as claimed in claim 9, wherein said first flywheel is connected at the front leg of said user by said connection means, said second flywheel is connected at the front of the left leg of said user by said connection means, said third flywheel is connected at the rear of the right leg of said user by said connection means and said fourth flywheel is connected at the rear of the left leg of said user by said connection means.

12. The apparatus as claimed in claim 8, wherein said first flywheel further consists of a right set of pulleys mounted underneath and to the rear of said frame allowing an element to be routed and connected by said connection means to the back side of the users right leg.

13. The apparatus as claimed in claim 8, wherein said second flywheel further consists of a left set of pulleys mounted underneath and to the rear of said frame allowing an element to be routed and connected by said connection means to the back side of the users left leg.

14. The apparatus as claimed in claim 1, wherein said multi-directional resistance means further consists of at least two hydraulic mechanisms with a recoil and a one way clutch.

15. The apparatus as claimed in claim 14, wherein said hydraulic mechanism further consists of hydraulic fluid, a reservoir, an adjustable orifice control, a one-way clutch, a recoil spool, a shaft and a pillow block bearing.

16. The apparatus as claimed in claim 1, wherein the rotation position of said hydraulic mechanism is adjustable.

17. The apparatus as claimed in claim 1, wherein said treadmill is substitutable for an ice skating stationary deck further comprising a UHMW cover.

18. The apparatus as claimed in claim 17, wherein said stationary deck further comprises a surface constructed of UHMW polyethylene material.

19. The apparatus as claimed in claim 18, wherein said UHMW polyethylene is substitutable for a plurality of materials.

20. The apparatus as claimed in claim 1, wherein said multi-directional resistance means further comprises a first and second hydraulic mechanism each with a recoil and one way clutch mounted on the front of said frame.

21. The apparatus as claimed in claim 1, wherein said multi-directional resistance means further consist of a first and second hydraulic mechanism mounted at the front of said frame and a third and fourth hydraulic mechanism mounted at the rear of said frame.

22. The apparatus as claimed in claim 15, wherein said one-way clutch is substitutable for a one-way bearing.

23. The apparatus as claimed in claim 20, wherein said first hydraulic mechanism further consists of a right set of pulleys mounted underneath to the rear and the front and mounted on top to the rear and the front of said frame.

24. The apparatus as claimed in claim 20, wherein said second hydraulic mechanism further consists of a left set of pulleys mounted underneath to the rear and the front and mounted on top to the rear and the front of said frame.

25. The apparatus as claimed in claim 1, wherein said multi-directional resistance means further consists of a first flywheel and a second flywheel mounted at the rear of said frame.

26. The apparatus as claimed in claim 1, wherein said multi-directional resistance means further comprises a first and second hydraulic mechanism each with a recoil and one way clutch mounted on the rear of said frame.

27. The apparatus as claimed in claim 1, wherein said apparatus further consists of a harness supported by a frame.

28. The apparatus as claimed in claim 1, wherein said treadmill is used in combination with skating boots with polytetrafluoroethylene coated rails.

29. The apparatus as claimed in claim 17, wherein said stationary deck is used in combination with skating boots with polytetrafluoroethylene coated rails.

* * * * *